US005143188A

United States Patent [19]

Robinet

[11] Patent Number: 5,143,188

[45] Date of Patent: Sep. 1, 1992

[54] ARTICLE INCORPORATING AT LEAST TWO COMPARTMENTS INTENDED TO CONTAIN VARIOUS OBJECTS

[75] Inventor: Jean-Louis Robinet, Neuilly-sur-Seine, France

[73] Assignee: Francois Marot S.A., Paris, France

[21] Appl. No.: 788,619

[22] Filed: Nov. 6, 1991

[30] Foreign Application Priority Data

Nov. 19, 1990 [FR] France ..... 90 14367

[51] Int. Cl.[5] ..... A45C 13/00

[52] U.S. Cl. ..... 190/111; 150/117; 190/103; 190/112

[58] Field of Search ..... 190/103, 109, 111, 112; 206/287.1; 383/2, 38, 41; 150/117

[56] References Cited

U.S. PATENT DOCUMENTS

| | | | |
|---|---|---|---|
| 2,025,101 | 12/1935 | Halpin | 190/111 |
| 2,086,326 | 7/1937 | Goldberg | 150/117 |
| 2,334,895 | 11/1943 | Bracken | 190/111 |
| 2,597,194 | 5/1952 | Sholl | 190/111 |
| 2,609,897 | 9/1952 | Meyer | 190/111 |
| 2,695,085 | 11/1954 | Ritter, Jr. | 190/111 |
| 2,717,015 | 9/1955 | Berry | 190/111 |
| 2,721,596 | 10/1955 | Danneil | 383/2 |
| 3,019,869 | 2/1962 | Engelhardt | 206/287.1 |
| 3,587,795 | 6/1971 | Berry | 190/103 |
| 4,156,480 | 5/1979 | Darbonnier | 190/111 |
| 4,236,615 | 12/1980 | Ginat | 190/103 |
| 4,887,700 | 12/1989 | Rice | 206/287.1 |
| 4,927,014 | 5/1990 | Pulichino, Jr. | 206/287.1 |
| 4,966,260 | 10/1990 | Young | 190/111 |

FOREIGN PATENT DOCUMENTS

| | | | |
|---|---|---|---|
| 3313195 | 10/1984 | Fed. Rep. of Germany . | |
| 2070575 | 9/1971 | France . | |
| 2565471 | 12/1985 | France . | |
| 2608026 | 6/1988 | France . | |
| 437876 | 11/1935 | United Kingdom | 190/109 |

OTHER PUBLICATIONS

Search Report Issued for FR-A-90 14 367.

*Primary Examiner*—Gary E. Elkins
*Attorney, Agent, or Firm*—Ladas & Parry

[57] ABSTRACT

A bag which has an outer envelope and at least two inner pouches housed therein, with the second inner pouch extending on the side of and beneath the first inner pouch. Each pouch is independently accessible through a closure device.

8 Claims, 4 Drawing Sheets

ARTICLE INCORPORATING AT LEAST TWO COMPARTMENTS INTENDED TO CONTAIN VARIOUS OBJECTS

FIELD OF THE INVENTION

The present invention relates to an article incorporating at least two compartments intended to contain various objects, such as a traveling bag, shoulder-bag, sports bag, handbag, pouch, toilet case, document-holder, or the like.

To facilitate the description, this multi-use article is referred to as a bag.

BACKGROUND OF THE INVENTION

A bag of this type is known and comprises an outer envelope in which an inner pouch is fixed. The pouch is intended to receive toilet objects or the like and is provided with a slide fastener. The outer envelope is intended to contain clothes, shoes or the like and is provided with a slide fastener. It is provided either with handles or with a shoulder strap.

To gain access to the pouch, the envelope must first be opened, thus rendering its contents visible while the toilet objects are being removed and replaced.

Furthermore, the capacity of the inner pouch is limited and it is difficult to maintain its shape and to keep straight, as, when said pouch is full. In addition, when the bag is full it is out-of-balance and suspended by one side only.

In addition, the capacity of the outer envelope cannot be significantly increased, despite the existence of gussets.

Finally, the deformations applied on the bag from the outside are directly transmitted to the contents through the wall, which may crease, deteriorate or break certain objects.

It is an object of the present invention to overcome these drawbacks by improving the known bag described above.

SUMMARY OF THE INVENTION

According to the invention, the inner pouch is integral (by stitching, adhesion or the like) with one side and a top of the outer envelope to define a first opening. A first rapid closure means being provided to close the lips of the opening and prevent access to the inner pouch. The top and the other side of the envelope defining a second opening for access thereto, the lips of which opening may be joined by a second rapid closure means. Furthermore, the top of the outer envelope is a pleated band of which each end is integral with the edge of a notch of complementary shape defined by the corresponding end wall of this envelope.

In this way, access to each compartment does not necessitate opening the other compartment. Moreover, when the inner pouch is full, it is perfectly suspended and balanced, which avoids the contents being upset.

An adjustable strap joins the two arms of each end wall of the outer envelope separated by the corresponding notch, in order to flatten more or less the pleated band and thus to determine the usable volume of the bag.

The bag may be provided with a shoulder strap of which each end is divided into two bands extending in V-form and fixed on the two arms of the corresponding end wall.

Furthermore, a second open inner pouch may be housed in the outer envelope, being capable of occupying at least part of the space left free by the first pouch, this second pouch being integral with the envelope near the second closure means so that it is closed thereby.

The outer envelope may be deeper than the first pouch, said second pouch extending on the side of and below the first.

According to a variant embodiment, the second pouch may also extend beneath a third pouch similar to the first and contiguous to the second side of the envelope.

In this way, the capacity of the compartment for stowing clothes, shoes or the like may be increased in connection with the volume of the contents. In addition, the presence of the second pouch enables said contents to be better protected.

BRIEF DESCRIPTION OF THE

The invention will be more readily understood on reading the following description with reference to the accompanying drawings, in which:

FIGS. 1 and 1*a* are perspective views illustrating a traveling bag according to the invention, with handles and shoulder strap, respectively.

FIG. 2 schematically shows a transverse section along line II—II of FIG. 1, in a first, simplified embodiment of the bag.

DETAILED DESCRIPTION OF THE DRAWINGS

Figure 1:
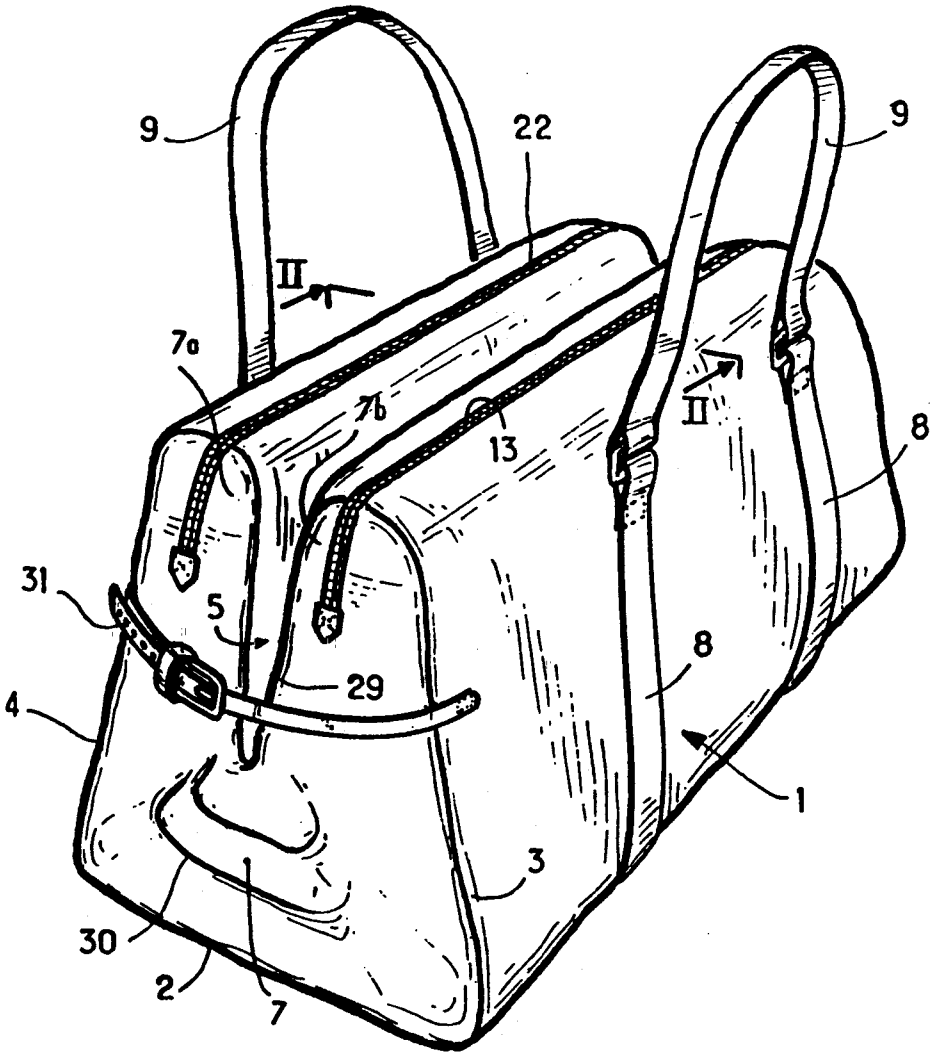
Figure 2:
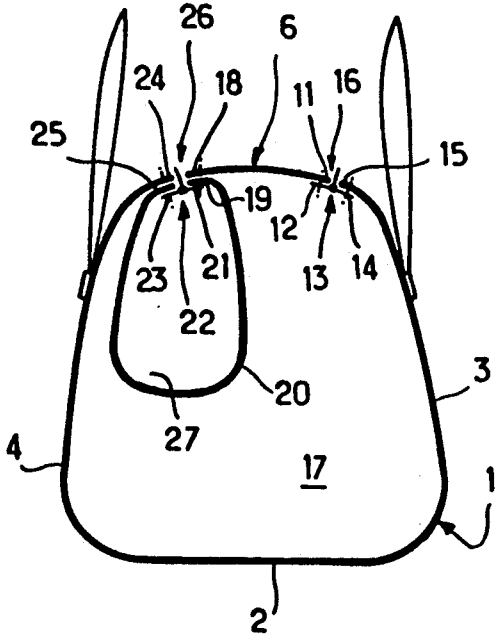

Referring now to the drawings, and firstly to FIGS. 1 and 2, the bag comprises an outer envelope 1, for example made of leather, presenting a bottom 2, two sides 3, 4, a top 5 (FIG. 1) or 6 (FIG. 2), and end walls 7.

In the mode of carrying shown in FIG. 1, the sides and the bottom are provided with reinforcing bands 8 at the top of which handles 9 are fixed via rectangular rings.

Figure 1A:
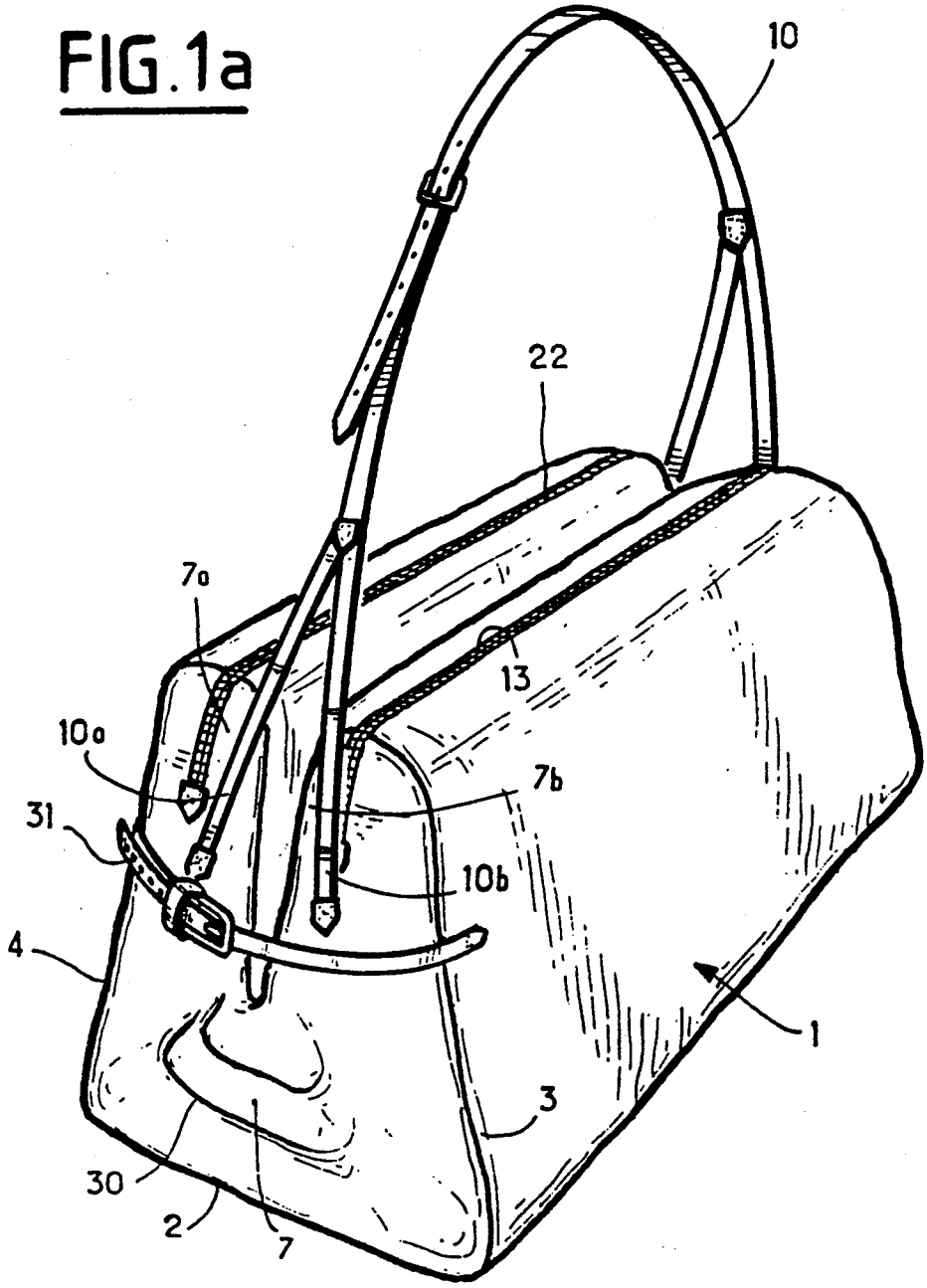

In the mode of carrying of FIG. 1*a*, an adjustable shoulder strap 10 is provided. Each of its ends is divided into two bands 10*a*, 10*b* extending in V-form and fixed at their ends to the arms 7*a*, 7*b* described hereinafter of the corresponding end wall 7 of the envelope 1. When the capacity of the envelope increases and said arms 7*a*, 7*b* move away from each other, bands 10*a*, 10*b* do the same.

According to the first embodiment illustrated in FIG. 2, the top 6 is a narrow band.

A first longitudinal edge 11 of this band 6 is fixed, by any appropriate means such as stitching, adhesion, clipping, . . . on one of the mating elements 12 of a rapid closure means 13, the other element 14 thereof being fixed on the edge 15 of the side 3. When the closure means 13 is undone, it gives access via opening 16 to a large compartment 17 of the bag.

The second longitudinal edge 18 of the top 6 and a first edge 19 of an inner pouch 20 are fixed on one of the mating elements 21 of a rapid closure means 22 of which the other element 23 is fixed on the edge 24 of the side 4 and on the second edge 25 of the inner pouch 20. When closure means 22 is undone, it gives access via opening 26 to a small compartment 27 of pouch 20.

Closure means 13 and 22 may be of any type: slide fastener, interlocking elements of the "Velcro" type, press-buttons, or the like.

Opening of closure means 13 gives access to the large compartment 17 defined by envelope 1 on the side of and below pouch 20 and without it being necessary to open the latter.

Opening of closure means 22 gives access to the small compartment 27 defined by pouch 20, without it being necessary to open the large compartment 17.

Figure 4:
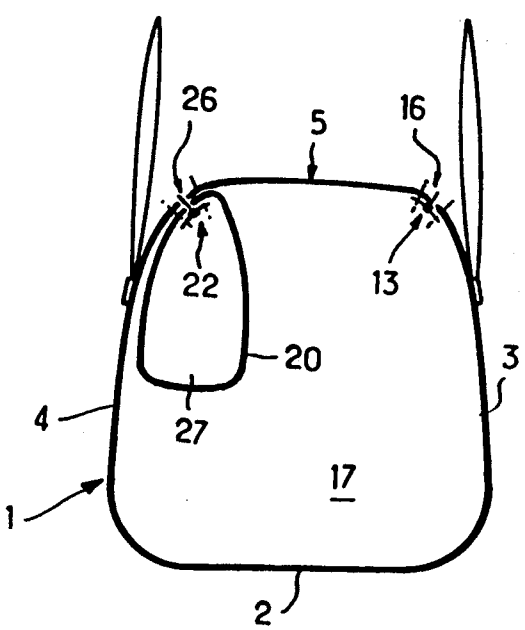
FIGS. 3 and 4 are views similar to FIG. 2, showing a second embodiment of the bag, thanks to which the capacity thereof may be adapted to requirements, the bag of FIG. 3 having a minimum capacity and the one according to FIG. 4, a maximum capacity.
Figure 3:
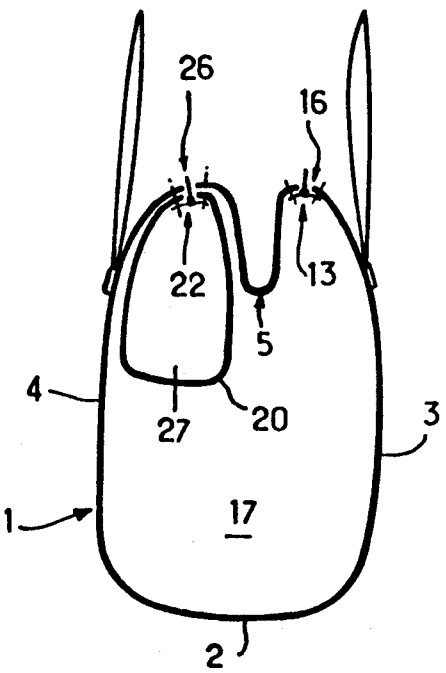

According to the second embodiment illustrated in FIGS. 1, 3 and 4, the top 5 is a wider band which, at rest, is pleated in V-form. It might be pleated as a W or the like.

Edges 11 and 15 of this band 5 and of the side 3 respectively are joined together by the rapid closure means 13 mentioned above which, when it is opened, gives access to the large compartment 17 via opening 16.

Edges 18 and 19 of this band 5 and of pouch 20 are joined to edges 24 and 25 of side 4 and of pouch 20 by the rapid closure means 22 mentioned above which, when it is opened, gives access to the small compartment 27 via opening 26.

Each end 18 of the pleated band 5 is integral by any appropriate means (stitching, adhesion or the like) with the edge of a notch 29 formed in the corresponding end wall 7 of the bag, notch 29 has a shape which conforms with the shape of an end edge of pleated band 5 so as to form and separating arms *7a*, *7b* of end wall 7.

In this position illustrated in FIGS. 1 and 3, the walls 7 present well-shaped pleats 30 so that they can be deformed when, in order to increase the filling capacity of the compartment 17, said band 5 is stretched (FIG. 4), this having for its effect to space the rapid closure means 13 and 22 apart from each other.

In order to regulate this capacity as a function of needs, adjustable straps 31 (with buckle, interlocking strips of the "Velcro" type, . . . ) join the sides 3 and 4, passing over the end walls 7. These straps determine the angular aperture of the pleat of band 5, and the distance between rapid closure means 13 and 22.

Figure 6:
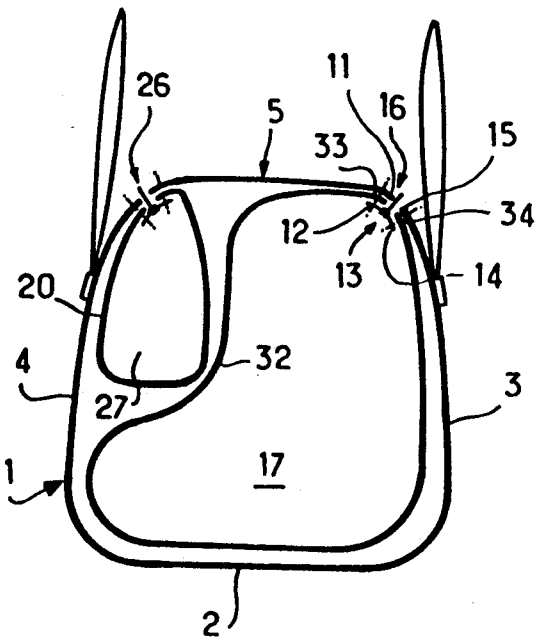
FIGS. 5 and 6 are views similar to FIGS. 3 and 4, showing a third, improved embodiment of the bag.
Figure 5:
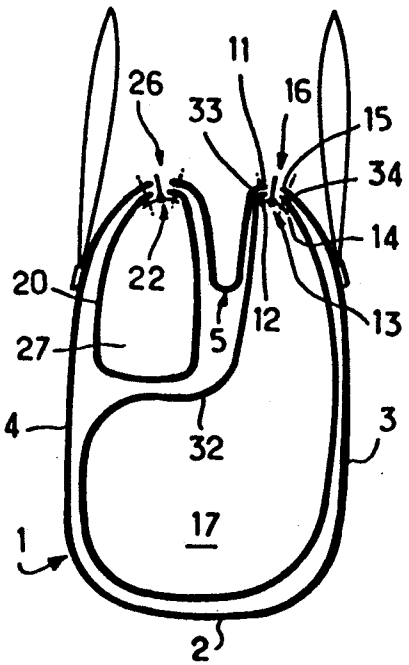

According to the third embodiment illustrated in FIGS. 5 and 6, a second pouch 32 is housed in the envelope 1 and extends along the first pouch 20, and therebeneath. This second pouch is intended to isolate from the outer envelope 1 the contents of the large compartment 17 which it defines.

A first edge 33 of this pouch 32 is fixed with the edge 11 of the band, 6 and the element 12 of the closure means 13, while the second edge 34 of said pouch 32 is fixed with the edge 15 of the envelope 1 and the element 14 of said closure means. This closure means 13 is therefore capable of giving access to compartment 17 of pouch 32 via opening 16.

Figure 7:
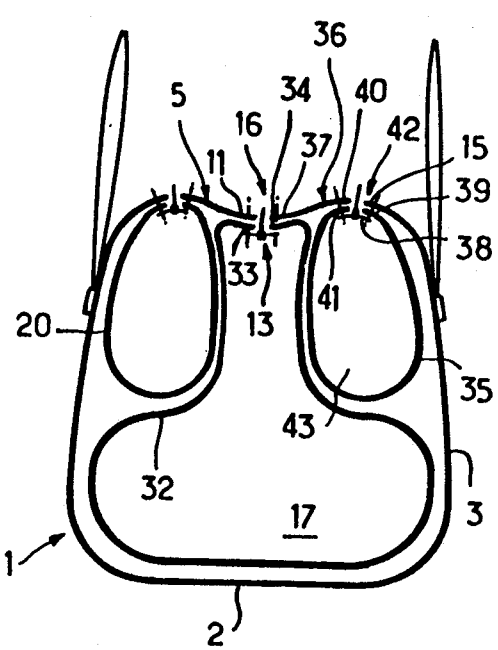
FIG. 7 is a view similar to FIG. 6, concerning a fourth embodiment.

According to a fourth embodiment illustrated in FIG. 7, the bag contains a third pouch 35 similar to the first, 20, but disposed against the opposite side 3 of the envelope 1. In that case, the band 5 cooperates with a narrow band 36.

The closure means 13 joins the edges 11 of the pleated band 5 and 33 of the large pouch 32, to a first edge 37 of the narrow band 36 and to the edge 34 of said pouch. As before, this closure means 13 is capable of giving access to compartment 17 of pouch 32 via opening 16.

A third closure means 38 joins the edges 15 of the envelope 1 and 39 of pouch 35 to the edges 40 of the narrow band 36 and 41 of said pouch 35. This closure means 38 is therefore capable of giving access to the small compartment 43 of pouch 35, via an opening 42.

In this fourth embodiment, the large pouch 32 extends between the small pouches 20 and 35, as well as therebeneath.

Whatever the embodiment, it is obvious that the means for fixing any one of the pouches on the outer envelope may be independent of those which ensure assembly of the rapid closure means.

What is claimed is:

1. An article incorporating at least two independently accessible compartments which are intended to contain various objects therein, comprising:

an outer envelope having a pleated top surface with first and second longitudinal edges and opposite end edges, opposite side surfaces having top edges adjacent the first and second longitudinal edges, a bottom surface, and opposite end wall surfaces with each end wall surface having a notch formed therein which conforms with the shape of the opposite end edges of the top surface and which forms arm portions on each end wall surface;

a first closure means connecting the first longitudinal edge with the top edge of one side surface, the first closure means is moveable so that in a first closed position the first closure means prevents access to the interior of the outer envelope and in a second opened position the first closure means defines a first opening to provide access to the interior of the outer envelope;

at least one first inner pouch housed within the outer envelope and contiguous to one side surface of the outer envelope, the first inner pouch having lip portions that are joined to the outer envelope and the first closure means so that when the first closure means is in the second position the first inner pouch is accessible from outside the outer envelope, and wherein the outer envelope is deeper than the first inner pouch;

a second closure means connecting the second longitudinal edge with the top edge of the other side surface, the second closure means is moveable so that in a first closed position the second closure means prevents access to the interior of the outer envelope and in a second opened position the second closure means defines a second opening to provide access to the interior of the outer envelope; and at least one second inner pouch housed within the outer envelope and contiguous to the other side surface of the outer envelope, the second inner pouch having lip portions that are joined to the outer envelope and the second closure means so that when the second closure means is in the second position the second inner pouch is accessible from outside the outer envelope, and wherein the second inner pouch extends into the outer envelope along one side of, and beneath, the first inner pouch.

2. The article of claim 1, further comprising an adjustable strap that is connected to the side surfaces of the outer envelope so that the adjustment of the strap can draw the side surfaces together and flatten the pleated top surfaces and thus reduce the usable volume of the bag.

3. The article of claim 2, further comprising a shoulder strap of which each end of the shoulder strap is divided into separate bands that are fixed on the arms of the corresponding opposite end wall surfaces.

4. The article of claim 2, further comprising handles that are attached to the opposite side surfaces.

5. An article incorporating at least three independently accessible compartments which are intended to contain various objects therein, comprising:

an outer envelope having a pleated top surface comprised of a first band and a second band adjacent to each other and each band having first and second longitudinal edges and opposite end edges, opposite side surfaces having top edges adjacent the first longitudinal edge of each band, a bottom surface, and opposite end wall surfaces with each end wall surface having a notch formed therein which conforms with the shape of the opposite end edges of the bands and which forms arm portions on each end wall surface;

a first closure means connecting the first longitudinal edge of the first band with the top edge of one side surface, the first closure means is moveable so that in a first closed position the first closure means prevents access to the interior of the outer envelope and in a second opened position the first closure means defines a first opening to provide access to the interior of the outer envelope;

at least one first inner pouch housed within the outer envelope and contiguous to one side surface of the outer envelope, the first inner pouch having lip portions that are joined to the outer envelope and the first closure means so that when the first closure means is in the second position the first inner pouch is accessible from outside the outer envelope, and wherein the outer envelope is deeper than the first inner pouch;

a second closure means connecting the first longitudinal edge of the second band with the top edge of the other side surface, the second closure means is moveable so that in a first closed position the first closure means prevents access to the interior of the outer envelope and in a second opened position the second closure means defines a second opening to provide access to the interior of the outer envelope;

at least one second inner pouch housed within the outer envelope and contiguous to the other side surface of the outer envelope, the second inner pouch having lip portions that are joined to the outer envelope and the second closure means so that when the second closure means is in the second position the second inner pouch is accessible from outside the outer envelope, and wherein the outer envelope is deeper than the second inner pouch;

a third closure means connecting the second longitudinal edge of the first band with the second longitudinal edge of the second band, the third closure means is moveable so that in a first closed position the second closure means prevents access to the interior of the outer envelope and in a second opened position the second closure means defines a third opening to provide access to the interior of the outer envelope; and at least one third inner pouch housed within the outer envelope, the third inner pouch having lip portions that are joined to the outer envelope and the third closure means so that when the third closure means is in the second position the third inner pouch is accessible from outside the outer envelope, and wherein the third inner pouch extends into the outer envelope along one side of, and beneath, the first and second inner pouches.

6. The article of claim 5, further comprising an adjustable strap that is connected to the side surfaces of the outer envelope so that the adjustment of the strap can draw the side surfaces together and flatten the pleated top surface and thus reduce the usable volume of the bag.

7. The article of claim 6, further comprising a shoulder strap of which each end of the shoulder strap is divided into separate bands that are fixed on the arms of the corresponding opposite end wall surfaces.

8. The article of claim 6, further comprising handles that are attached to the opposite side surfaces.

* * * * *